US005441609A

United States Patent [19]

Olper

[11] Patent Number: 5,441,609

[45] Date of Patent: Aug. 15, 1995

[54] PROCESS FOR CONTINUOUS ELECTROCHEMICAL LEAD REFINING

[75] Inventor: Marco Olper, Monza, Italy

[73] Assignee: B.U.S. Engitec Servizi Ambientali S.R.L., Milan, Italy

[21] Appl. No.: 105,062

[22] Filed: Aug. 12, 1993

[51] Int. Cl.[6] ..... C25B 1/24; C25C 1/18

[52] U.S. Cl. ..... 204/94; 204/115

[58] Field of Search ..... 204/115, 290 R, 94; 205/252, 299; 423/90, 98; C25C 1/18

[56] References Cited

FOREIGN PATENT DOCUMENTS 041687 2/1991 European Pat. Off. .
0411687 2/1991 European Pat. Off. .
0508960 10/1992 European Pat. Off. .

*Primary Examiner*—Kathryn Gorgos
*Attorney, Agent, or Firm*—Foley & Lardner

[57] ABSTRACT

Raw lead to be refined, whether of mineral origin or from reclaiming operations, the particle size of which has been reduced to a range not larger than 50 mm, is leached in a suitable apparatus with a solution of ferric fluoroborate in fluoroboric acid. During the leaching step, lead is dissolved, with ferric fluoroborate being reduced to ferrous fluoroborate according to the following reaction:

$$2Fe(BF_4)_3 + Pb \rightarrow Pb(BF_4)_2 + 2Fe(BF_4)_2$$

The leaching apparatus behaves as an external anode installed outside of the cell. The solution resulting from the leaching step is sent to the cathodic compartment of a diaphragm cell in which lead is deposited on a cathode of stainless steel, in compact, highly pure form. The solution that is depleted of lead then is sent to the anodic compartment of the same cell, in which a suitable anode oxidizes ferrous fluoroborate to ferric fluoroborate that can be regenerated to the leaching step.

15 Claims, 1 Drawing Sheet

PROCESS FOR CONTINUOUS ELECTROCHEMICAL LEAD REFINING

BACKGROUND OF THE INVENTION

1. Field of the Invention

The present invention relates to a process for purifying the impure lead contained in recovered lead fixtures and in scraps and processing wastes, with the melting processes being eliminated which are presently essential for the thermal refining or for the preparation of the suitable anodes for the electrolytic refining, in the event when this refining system is adopted.

2. Description of Related Art

As is known, the electrolytic lead refining is carried out in cells to which massive anodes are charged, which are manufactured by melting impure lead and casting it into suitable molds, and cathodes, constituted by thin sheets of lead or stainless steel on which the refined lead is deposited owing to the effect of the electrical field established between the anode and the cathode.

The electrolyte is generally constituted by an aqueous solution of lead fluorosilicate containing free fluorosilicic acid, and the addition of additives in order to obtain a deposit displaying good characteristics.

The massive anodes of the known type suffer from several drawbacks and limitations of practical character: first of all, the anodes which get exhausted have to be removed at pre-established time intervals, with the production cycle being discontinued.

Furthermore, the so-said "anodic residues" which constitute from 20 to 25% of the initial weight have to be melted once more, and this is a further additional cost.

The anodic sludges often get detached from the anodes, get accumulated on the bottom of the electrolytic cell, and must be periodically removed. Furthermore, the sludges can get dispersed throughout the bath and constitute a polluting agent for the deposit.

Then, it should be observed that the anodes to be refined should display a limited level of impurities (Cu, Sn, Sb, As, Bi), the total amount of which does not normally exceed 2–3%, and normally have to be submitted to a pre-refining process, with consequent slagging of 3–5 parts of lead per each part of impurities to be removed.

The present refining system with massive anodes of impure metal displays the characteristic that the anodic surface is very close to the cathodic one, and hence has a very similar current density, expressed as $A/m^2$.

It derives from the above that the cathodic current density, and, consequently, substantially, the production capacity of the facility, cannot be increased beyond certain threshold values, in order to prevent that anodes do not become passivated, or cathodic deposits of poor quality are obtained.

The presence of sludges which, when a large amount of impurities are present, adhere to the anode, prevents the use of techniques which may increase the lead diffusion coefficient in the double cathodic layer, such as strong circulation rates or stirring techniques, for fear of detaching the layer of anodic sludges, with seriously negative consequences for the purity of the metal deposited at the cathode.

As electrolysis goes on, the layer of anodic sludges reaches considerable thickness, with the anodic dissolution potential being increased. When this anode dissolution potential reaches the value of impurities dissolution potentials, the impurities are dissolved and are deposited at the cathode.

In order to obviate this drawback, either the current density is reduced, or the anodes are frequently extracted from the cells in order to clean them from the sludges.

Most electrolytic lead refineries presently installed operate with a cathodic density of abound 200 $A/m^2$. When the level of impurities exceeds the normal level of 2–3%, the current density must be drastically reduced, down to 25% of normal values, with dramatic production drops.

Summing-up, the refining system with massive anodes containing high level of impurities suffers from a large number of electrochemical limitations, requires melting and thermal pre-refining furnaces, a complex casting system, a complex handling system for the new anodes, the anodic residues and the anodes from which the sludges must be removed during the refining cycle.

SUMMARY OF THE INVENTION

The purpose of the present invention basically is of dissolving the lead to be refined, without any preliminary treatments, possibly except for a simple decrease in particle sizes, outside of the electrolytic cell.

In order to achieve such a purpose, the present invention proposes a process for electrochemical lead refining, characterized in that it comprises the following steps:

(a) leaching lead with a solution of ferric fluoroborate in fluoroboric acid, causing the lead to be dissolved according to the following reaction:

$$2Fe(BF_4)_3 + Pb \rightarrow Pb(BF_4)_2 + 2Fe(BF_4)_2$$

(b) filtering the resulting solution, (c) feeding the filtered solution to an electrolytic cell having a diaphragm, in which lead is deposited in pure form at the cathode and ferrous ions are oxidized to ferric ions at the anode, with the solution of ferric fluoroborate being thereby regenerated, (d) recycling the so-regenerated ferric fluoroborate solution to said step (a), in order to leach further lead.

Thus, according to the present invention, lead is anodically dissolved outside of the electrolytic system, as if the facility was provided with an external anode outside of the cell.

DETAILED DESCRIPTION

Figure 1:
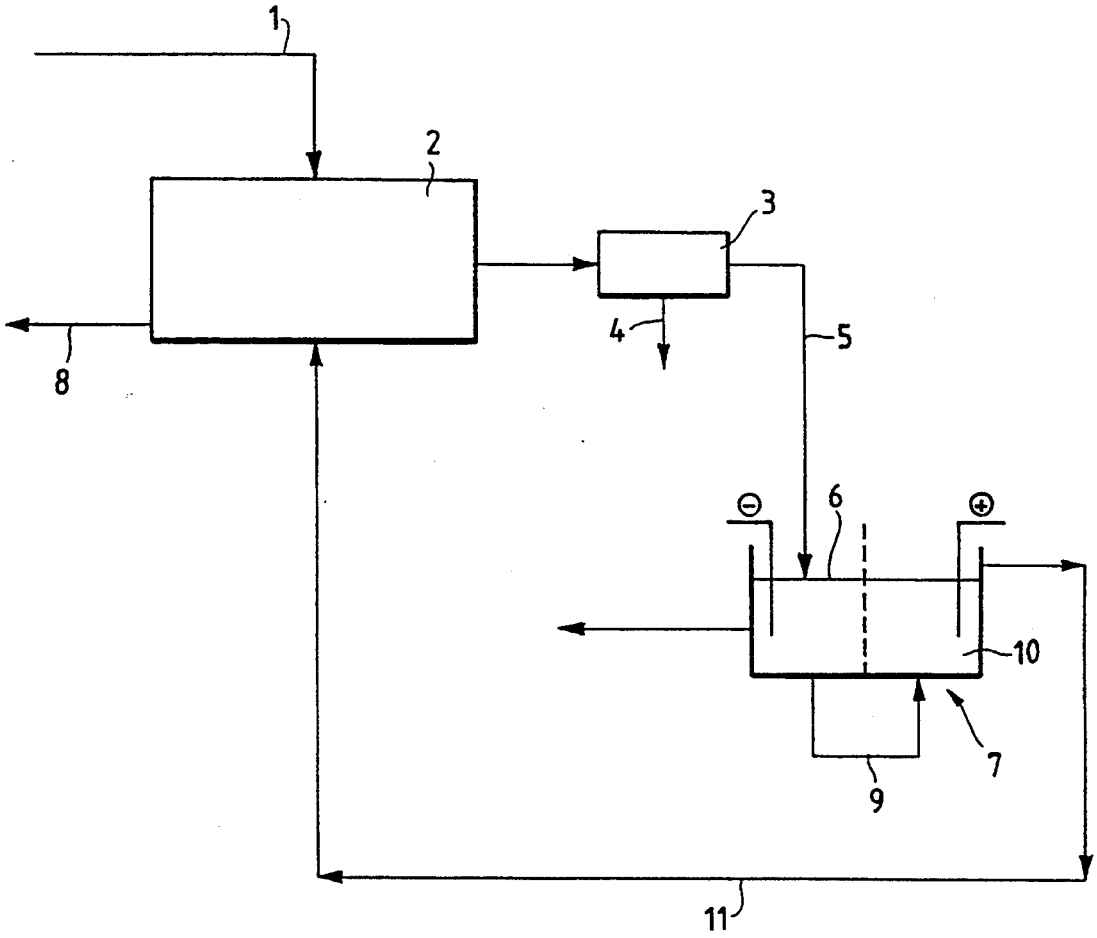
FIG. 1 represents a schematic of the process according to the present invention.

The metal impurities normally contained in recovered lead fixtures or in lead scraps have a higher electrochemical potential than of lead, so they are not dissolved until lead, which protects them cathodically, is present.

According to the present invention, the particle size of the lead to be refined is decreased down to a small range, preferably not higher than 20 mm.

The large surface area of crushed lead, or of lead in granular form, prevents that such high thicknesses of adhering sludges as to modify the electrochemical dissolution potential, may be established.

Nobler impurities than lead, therefore, are not dissolved. An exception is constituted by tin, which is dissolved, and could be co-deposited together with lead, by practically having the same electrochemical potential. However, in the process according to the present invention, inasmuch as the pair $Fe^{3+}/Fe^{2+}$ has a high potential, tin dissolved as $Sn^{2+}$ is oxidized to $Sn^{4+}$ and precipitates as $Sn(OH)_4$.

After being filtered, the solution is fed to the cathodic compartment of an electrochemical cell having a diaphragm, in which lead is deposited on a matrix of same lead or of stainless steel, in a very pure and compact form.

The depleted-of-lead electrolyte is sent to the anodic compartment inside which ferrous fluoroborate is oxidized to ferric fluoroborate, with the oxidizing power of the same solution being restored.

By means of this arrangement, a system is provided which no longer is of batch type, as it occurs in the case of the facilities known from the prior art, so periodically removing of the partially exhausted anodes of the cell in order to replace them with new anodes, is no longer necessary.

In that way, those dead times of anode extraction and replacement are eliminated, with a practically uninterrupted refining cycle being made available, because the anodes envisaged in the present invention are insoluble and consequently permanently inserted in the cell.

According to the present invention, all the other drawbacks as reminded above with regard to the anodes known from the prior art, can be solved.

The lead to be refined should be in the form of small particles of scraps, fragments or in bead form with a particle size not larger than 50 mm, and preferably 20 mm. The metal fragments or particles to be refined are charged in bulk to the dissolver which can be an empty tower through which the leaching solution is continuously circulated from bottom upwards so that, with the dissolution taking place from the bottom, the level of the metal contained inside the tower continues to decrease, with the introduction being made possible of further material which meets the solution which is more and more exhausted as for its oxidizing power, but is richer and richer with lead.

The leaching solution can also contain ferrous fluoroborate, lead fluoroborate and further suitable compounds, as well as leveling agents for deposited metal.

When it leaves the column, the solution will have such an oxidation potential, as determined by the ratio of $Fe^{3+}/Fe^{2+}$ as to be in equilibrium with the potential of the reaction:

$$Pb-2e=Pb^{++}.$$

The solution, after being filtered in order to eliminate any possible suspended particles, is continuously sent to the electrolytic cell for lead deposition.

The impure lead can also be dissolved by means of other systems, as stirred reactor or revolving reactor, which are capable of securing an intimate contact between the solution and the material to be leached.

The invention is better disclosed now by means of the following example , made by referring to the flow diagram of FIG. 1, which shall not be construed as being limitative.

EXAMPLE

The scraps from grids and poles obtained from the demolition of old batteries and subsequent classification by means of a hydrodynamic separator, when melted, yield a lead alloy containing 3.85% of Sb; 0.05 of Sn; 0.20 of Cu; 0.10 of As; 0.020 of Bi; 0.003 of Ag.

If electrolytic lead had to be obtained by means of a technique based on anode casting according to the prior art, the metal should be submitted now to a thermal pre-refining step, in order to remove Cu, As, Sn, to prevent that these impurities do not reach the cathodes. Furthermore, at approximately half anode life, removing the sludge from the anodic surface would become necessary in order to prevent the consequent increase in cell voltage and hence reaching the antimony dissolution potential.

Referring to the flow diagram of the accompanying drawing, according to the process of the present invention, lead fragments to be refined—coming from (1)—were charged, without any preliminary treatments, directly to a leaching apparatus (2) formed by a tower, inside which a solution is circulated which is constituted by free fluoroboric acid, ferric fluoroborate, ferrous fluoroborate, lead fluoroborate, with addition of deposit leveling agents.

After being filtered in (3), with the insoluble portions (4) being separated, the lead-enriched solution (5) is sent to the cathodic compartment of an electrolytic cell (7), where it is deposited. The parent cathodes are stainless steel sheets with perimetrical polyvinyl chloride (PVC) edge bands. The cathodic current density was kept, throughout the test time, at 200 $A/m^2$. The cell voltage at 40° C. remained at 1.15 V.

After a 800-hour electrolysis carried out by extracting the cathodes every 72 hours and adding the corresponding scrap batch, the resulting Pb, obtained as a cathode sheet of 6 mm of thickness, had the following average composition:

Sb<10 ppm
Sn<1 ppm
As<10 ppm
Cu<10 ppm
Bi<5 ppm
Ag<2 ppm
Ni<3 ppm
Pb balance.

The purity of lead resulted to be 99.995+. At the test end, from the bottom of the leaching tower (2), a sludge (8) was removed which had the following composition, based on dry matter:

Sb 62.5%
Cu 3.42%
As 5.09%
Pb 26.85%
Ag 0.05%
Bi 0.07%

The sludge amount corresponded to approximately 6% of charged scrap.

The solution (9) leaving the cathodic compartment (6) of the cell (7) is sent to the anodic compartment (10) of the same cell, in which the anode oxidizes ferrous fluoroborate to ferric fluoroborate, which is recycled, through (11), to the leaching tower (2).

The electrochemical reactions which take place in the cell can be represented as follows:

$$\begin{array}{ll} \text{at the cathode} & Pb(BF_4)_2 + 2e \rightarrow Pb + 2BF_4^- \\ \text{at the anode} & 2Fe(BF_4)_2 + 2BF_4^- - 2e \rightarrow Fe(BF_4)_3 \\ \hline \text{total reaction} & 2Fe(BF_4)_2 + Pb(BF_4)_2 \rightarrow Pb + 2Fe(BF_4)_3 \end{array} \quad (2)$$

The oxidizer power is so restored of the solution, which is returned to the step of leaching of further lead to be refined.

In more general terms, one of the main elements which characterize the present invention, is the use of fluoroboric electrolyte.

This acid, to the contrary of fluorosilicic acid used for lead deposition according to the prior art, displays the characteristic of complexing the metal ions present in solution, with a complexing power which is proportional to the ion charge density.

This characteristic is of basic importance in the present invention; in fact, on the one hand, the deposition of a metal from a complex is known to make it possible to obtain better deposits, with a finer crystalline texture and therefore with lesser inclusions of impurities in the deposit. On the other hand, the high complexing power of $BF_4-$ ion for $Fe_3+$ ion with complexes of type $[Fe(BF_4)_3]_{3+nn+}$ being formed, prevents iron in oxidated form from flowing from the anodic compartment, through the diaphragm, into the cathodic compartment where, should such an event take place, the deposit would be dissolved, with drastically negative consequences at current efficiency level and, therefore, as regards energy consumption per each deposited lead unit weight.

It is evident that the impurities remain out from the electrochemical system constituted by the cell, so the impurities contained in the lead to be refined have no influence on lead deposition parameters.

I claim:

1. A process for electrochemical lead refining, comprising the following steps:

(a) leaching lead with a solution of ferric fluoroborate in fluoroboric acid and without any preliminary treatment, to cause the lead to be dissolved according to the following reaction:

$$2Fe(BF_4)_3+Pb\rightarrow Pb(BF_4)_2+2Fe(BF_4)_2$$

(b) filtering the resulting solution;

(c) feeding the filtered solution to an electrolytic cell having a diaphragm, in which lead is deposited in pure form at the cathode and ferrous ions are oxidized to ferric ions at the anode, to generate a solution of ferric fluoroborate; and (d) recycling said ferric fluoroborate solution to said step (a), to leach more lead.

2. A process according to claim 1, wherein said lead to be leached according to step (a) is reduced to a particle size not larger than 50 mm.

3. A process according to claim 2, wherein said lead is reduced to a particle size not larger than 20 mm.

4. A process according to claim 1, wherein said solution of ferric fluoroborate also contains ferrous fluoroborate and lead fluoroborate.

5. A process according to claim 1, wherein said lead contains Sn, which, in said leaching step (a), precipitates as $Sn(OH)_4$, said precipitate being removed from the solution in said filtering step (b).

6. Refined lead obtained by means of the process according to claim 1.

7. Lead coated cathode as obtained in the step (c) of the process according to claim 1, 8. A process according to claim 1, wherein said lead is leached in step (a) without subjecting said lead to a thermal pre-refining furnace.

9. A process according to claim 1, wherein the purity of lead deposited in step (c) is greater than 99.995% lead.

10. A process for electrochemical lead refining, comprising the steps of:

(a) leaching a mixture consisting essentially of lead with a solution of ferric fluoroborate in fluoroboric acid and without any preliminary treatment, to cause the lead in said mixture to be dissolved according to the following reaction:

$$2Fe(BF_4)_3+Pb\rightarrow Pb(BF_4)_2+2Fe(BF_4)_2$$

(b) filtering the resulting solution;

(c) feeding the filtered solution to an electrolytic cell having a diaphragm, in which lead is deposited in pure form at the cathode and ferrous ions are oxidized to ferric ions at the anode, to generate a solution of ferric fluoroborate; and (d) recycling said ferric fluoroborate solution to said step (a), to leach more lead.

11. A process according to claim 10, wherein said lead to be leached according to step (a) is reduced to a particle size not larger than 50 min.

12. A process according to claim 11, wherein said lead is reduced to a particle size not larger than 20 mm.

13. A process according to claim 10, wherein said solution of ferric fluoroborate also contains ferrous fluoroborate and lead fluoroborate.

14. A process according to claim 10, wherein said lead is leached in step (a) without subjecting said lead to a thermal pre-refining furnace.

15. A process according to claim 10, wherein the purity of lead deposited in step (c) is greater than 99.995% lead.

* * * * *